US006533064B1

(12) United States Patent
Kim et al.

(10) Patent No.: US 6,533,064 B1
(45) Date of Patent: Mar. 18, 2003

(54) NOISE REDUCTION DEVICE FOR USE IN RECIPROCATING COMPRESSOR USING A SIDE-BRANCH SILENCER

(75) Inventors: Byung Hwan Kim, Seoul (KR); Kyoo Han Lee, Seoul (KR); Jeong Woo Kim, Seoul (KR)

(73) Assignee: Daewoo Electronics Corporation, Seoul (KR)

( * ) Notice: Subject to any disclaimer, the term of this patent is extended or adjusted under 35 U.S.C. 154(b) by 0 days.

(21) Appl. No.: 09/533,254

(22) Filed: Mar. 23, 2000

(30) Foreign Application Priority Data

| | | |
|---|---|---|
| Oct. 20, 1999 | (KR) | 99-45506 |
| Oct. 20, 1999 | (KR) | 99-45507 |
| Oct. 20, 1999 | (KR) | 99-45508 |
| Oct. 20, 1999 | (KR) | 99-45509 |
| Oct. 20, 1999 | (KR) | 99-45510 |

(51) Int. Cl.[7] ..... F01N 1/02
(52) U.S. Cl. ..... 181/250; 181/403; 417/312
(58) Field of Search ..... 181/403, 229, 181/272, 250, 237, 254, 255; 417/312, 313

(56) References Cited

U.S. PATENT DOCUMENTS

| | | | | |
|---|---|---|---|---|
| 5,173,034 A | * | 12/1992 | Riffle | 417/312 |
| 5,328,338 A | * | 7/1994 | Hirano et al. | 181/403 |

FOREIGN PATENT DOCUMENTS

| | | |
|---|---|---|
| JP | 6043187 | 3/1985 |
| JP | 61197777 | 9/1986 |
| JP | 62193187 | 12/1987 |
| JP | 2161178 | 6/1990 |

* cited by examiner

*Primary Examiner*—Khanh Dang
(74) *Attorney, Agent, or Firm*—Pennie & Edmonds LLP

(57) ABSTRACT

A noise reduction device has a side branch silencer. The side branch silencer is formed within a discharge valve assembly which includes is divided into a discharge muffler, a gasket, a discharge valve piece and a valve plate. The side branch silencer is provided with a cutout formed through the gasket to communicate with a discharge passage formed through the gasket. The cutout is blocked vertically by both a lower surface of a muffler plate of the discharge muffler and an upper surface of the discharge valve piece.

18 Claims, 10 Drawing Sheets

NOISE REDUCTION DEVICE FOR USE IN RECIPROCATING COMPRESSOR USING A SIDE-BRANCH SILENCER

FIELD OF THE INVENTION

The present invention relates to a noise reduction device for use in a reciprocating compressor; and, more particularly, to a noise reduction device for use in a hermetic reciprocating compressor employed in a refrigerator, the noise reduction device incorporating therein a side-branch silencer formed in a discharge valve assembly.

DESCRIPTION OF THE PRIOR ART

Compressors often generate undesirably exceedingly high levels of noise. A certain kind of reciprocating compressor often produces noise having band ranges lower than about 4 kHz. Of the noises produced, noises having frequencies of 3.15 kHz and 2.5 kHz are most problematic because human ears are generally more sensitive to noises at these frequencies.

There is shown in FIGS. 1*a* through 2, one of the prior art hermetic reciprocating compressors. A main body of the compressor is mounted within a pair of cases 10 and 20. The compressor is largely divided into a frame 30, a motor 40 which rotates a shaft 60 and a machinery part 50 which transforms a rotational movement of the shaft 60 into a rectilinear movement of a piston 120, allowing the piston 120 to compress refrigerant gases and discharge the same.

The frame 30 supports the motor 40 and the machinery part 50 through supporting a side stopper 70 and a coil spring 80 which function as a cushioning means and a noise attenuation means, respectively.

The machinery part 50 includes a cylinder 110, the piston 120 rectilinearly moving within the cylinder 110, and a piston rod 130 connecting the piston 120 to a crank 61 of the shaft 60 to transform a rotational movement of the shaft 60 into a rectilinear movement of the piston 120. The rectilinear movement of the piston 120 within the cylinder 110 compresses refrigerant gases introduced into the cylinder 110 and discharges compressed gases therefrom.

A valve plate 140 having an intake port and a discharge port is mounted at one side of the cylinder 110. An intake muffler 150 and a discharge muffler 160 for guiding an intake and a discharge process of the refrigerant gases, respectively, are formed outside the valve plate 140. An intake and a discharge pipe 170 and 180 are connected to the intake and the discharge muffler 150 and 160, respectively. The discharge muffler 160 into which the refrigerant gases are compressed to a high temperature and a high pressure are discharged from the cylinder 110, attenuates the noise caused by a pulsation of the refrigerant gases which is discharged from the cylinder 110.

The discharge muffler 160 is provided with a muffler plate 182 having an intake hole through which the refrigerant gases are introduced into the cylinder 110, a discharge hole and a delivery hole (not shown), and a valve cover 184 having a first room communicating with the discharge hole and formed with an internal plate and an external plate. The discharge muffler 160 is also provided with a muffler cup 190 connected to the delivery hole of the muffler plate 182 and having a second room communicating with the delivery hole and the discharge pipe 180 connected to the muffler cup 190, and a noise reducer 200 connected to a side of the muffler cup 190 through a connection pipe 210.

In the discharge muffler 160 described above, when the piston 120 is reciprocated by the shaft 60 to compress the refrigerant gases, the compressed refrigerant gases are discharged through the discharge hole of the muffler plate 170 into the first room of the valve cover 184, and then are delivered through the delivery hole, to the muffler cup 190 and finally to the discharge pipe 180 in that order. Sounds generated by the pulsation of the refrigerant gases being discharged and by the refrigerant gases colliding on valves are attenuated by the noise reducer 200 connected to the muffler cup 190 via the connection pipe 210.

The noise reducer 200 described above, however, has shortcomings in that its efficiency in attenuating the noise is low and that it requires a large mounting space therefor in the hermetic reciprocating compressor.

SUMMARY OF THE INVENTION

It is, therefore, a primary object of the invention to provide a noise reduction device having an enhanced efficiency in attenuating a noise, especially, a noise at a particular frequency, without demanding any external mounting space for an installation thereof.

The above and other objects of the invention are realized by providing a noise reduction device for use in a hermetic reciprocating compressor, wherein the hermetic reciprocating compressor is provided with a discharge valve assembly having a discharge muffler, a gasket, a discharge valve piece and a valve plate, the discharge valve assembly being mounted on a cylinder block, the noise reduction device further comprising: a side branch silencer formed within a discharge valve assembly.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1A:
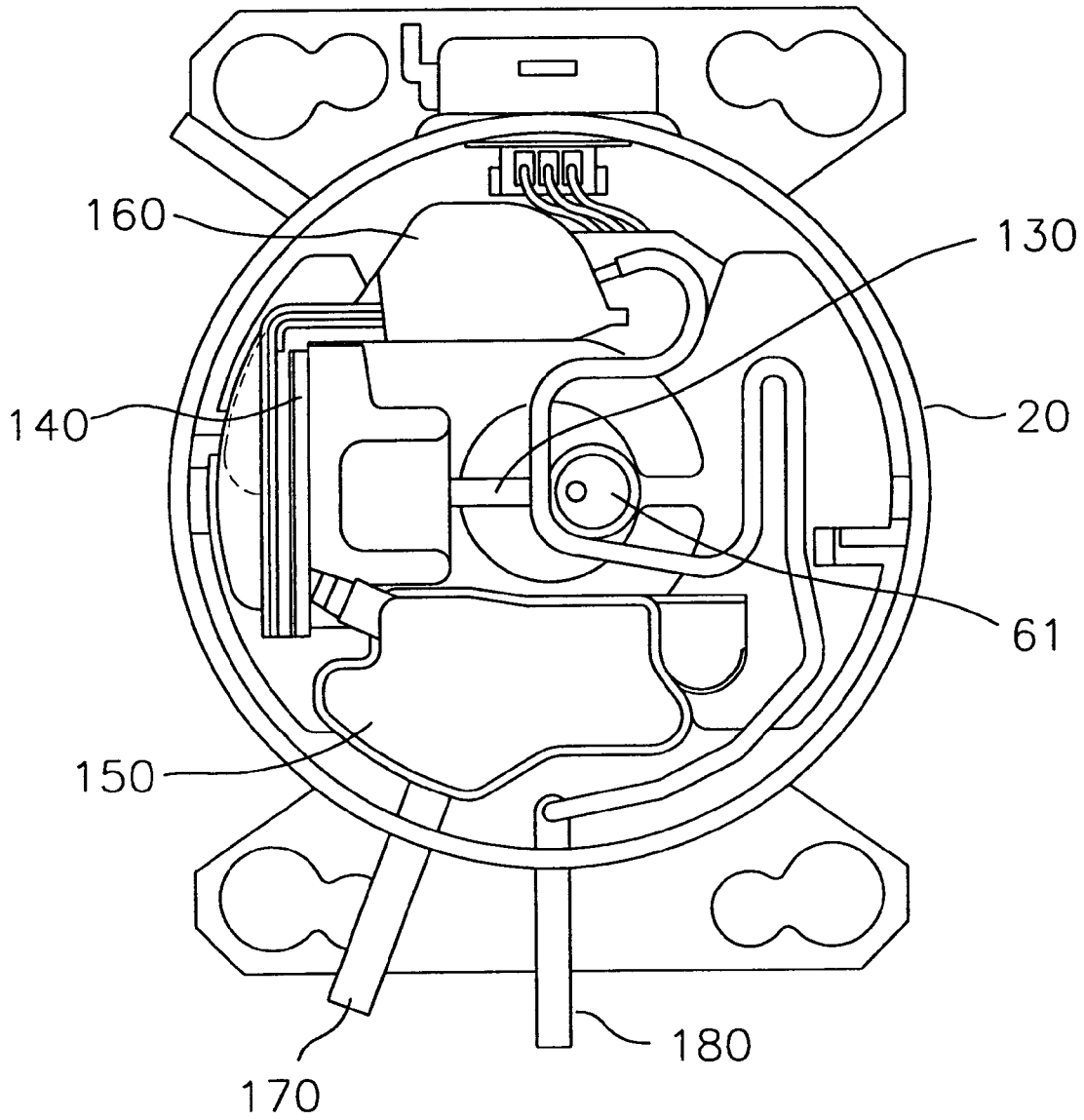
FIG. 1A (PRIOR ART)
FIGS. 1A and 1B illustrate a top planar sectional view and a frontal sectional view of a prior art hermetic reciprocating compressor, respectively.
Figure 1B:
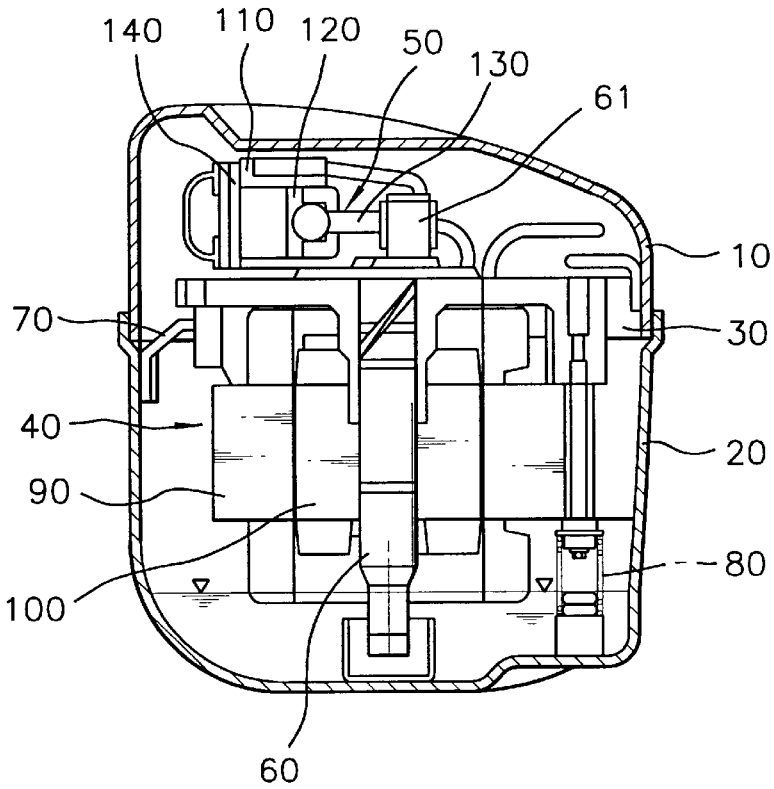
FIG. 1B (PRIOR ART)
Figure 2:
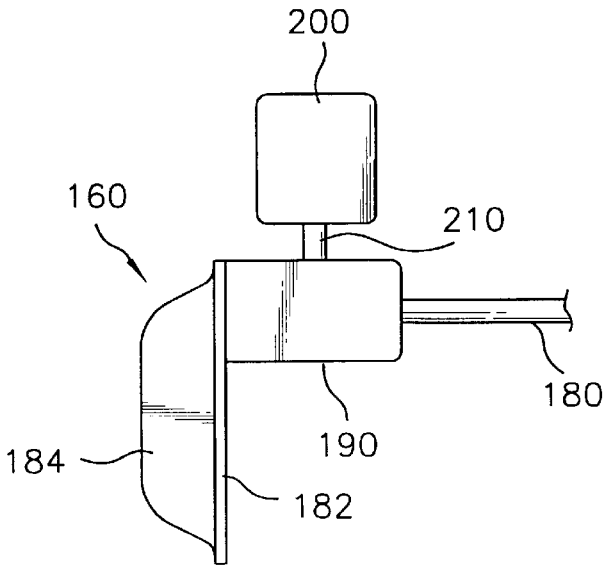
FIG. 2 (PRIOR ART)
FIG. 2 depicts a top planar view of a discharge muffler of the prior art.
Figure 3:
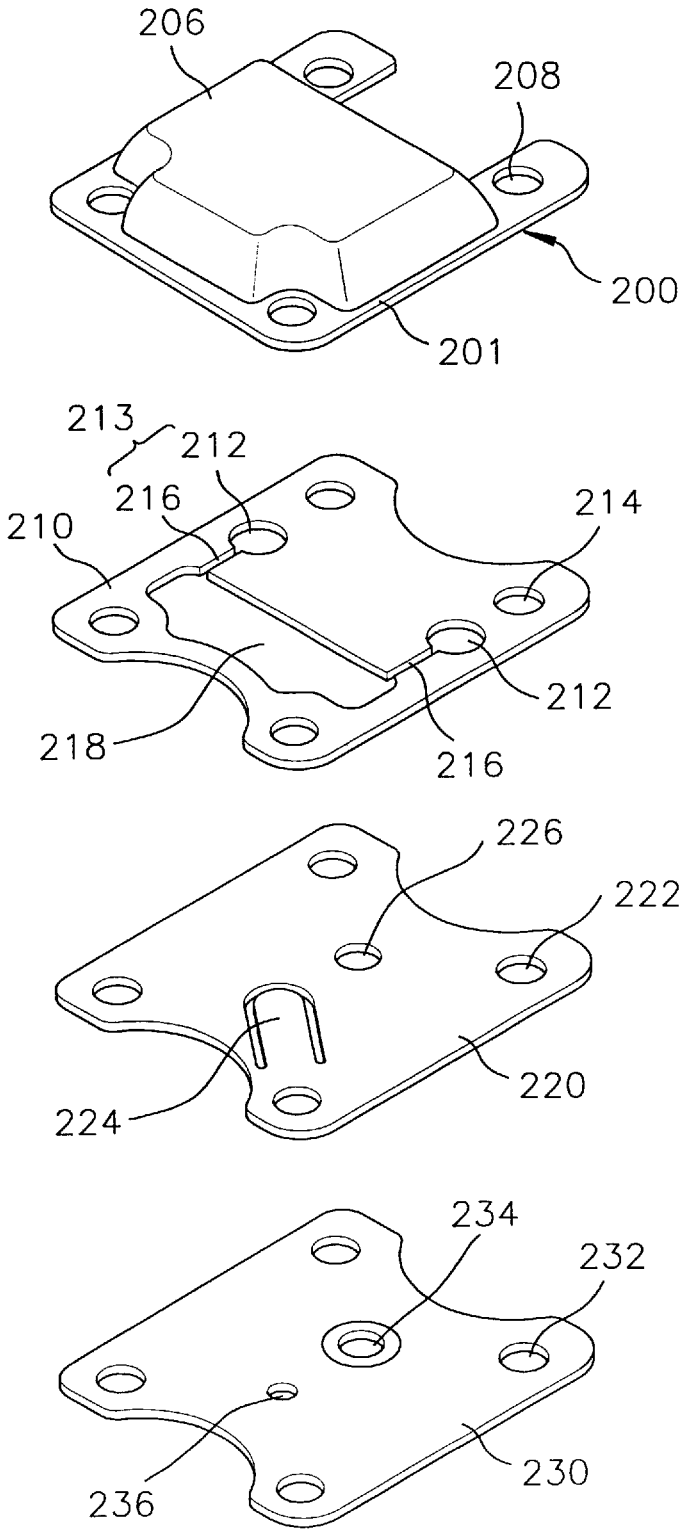
FIG. 3 shows an exploded perspective view of a first embodiment of the present invention.
Figure 4:
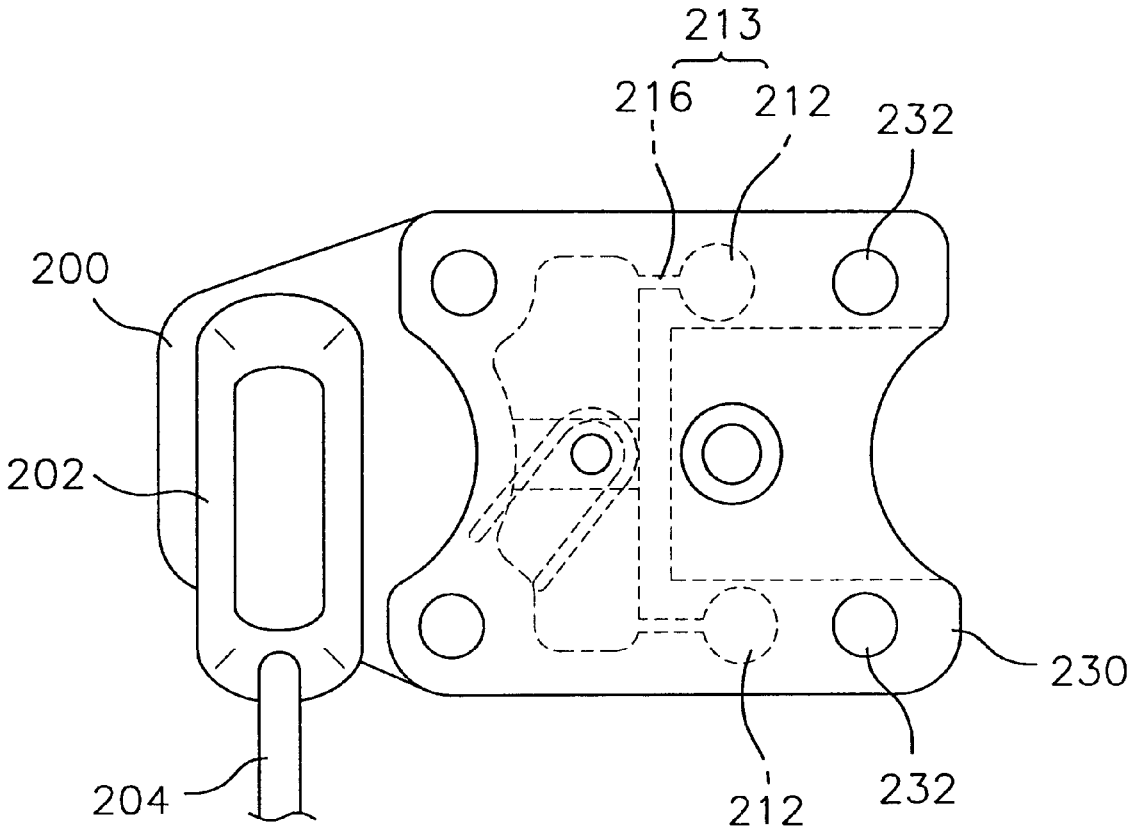
FIG. 4 presents a bottom view of the components shown in FIG. 3, when they are assembled together.

There is shown in FIGS. 3 and 4 a first embodiment of the inventive noise reduction device.

In FIG. 3, there is shown an exploded perspective view of a discharge valve assembly for use with a hermetic reciprocating compressor. The discharge valve assembly is provided with a discharge muffler 200, a gasket 210, a discharge valve piece 220 and a valve plate 230.

The discharge muffler 200 includes a muffler plate 201 and a discharge valve cover 206. The muffler plate 201 has an intake muffler hole (not shown) through which the refrigerant gases are introduced into a cylinder (not shown), and a discharge muffler hole (not shown) through which refrigerant gases are introduced from the cylinder into the discharge valve cover 206. A plurality of bolt holes 208 are formed through the muffler plate 201, through which bolts are engaged to fix the discharge muffler 200 on a cylinder block (not shown).

The gasket 210 for sealing the discharge valve assembly has a discharge passage 218 and a plurality of bolt holes 214 which are formed through the gasket 210, corresponding to the bolt holes 208 of the discharge muffler 200.

The discharge valve piece 220 has a reed valve 224 in a form of tongue, an intake piece hole 226 and a plurality of bolt holes 222.

The valve plate 230 has an intake plate hole 234, a discharge plate hole 236 and a plurality of bolt holes 232.

The discharge valve assembly are assembled with these components on the cylinder block with the bolts. That is, the valve plate 230 is first placed on the cylinder block; and then the discharge valve piece 220, the gasket 210 and the discharge muffler 200 are superposed on the valve plate 230 in that order as shown in FIG. 3.

In the first embodiment of the present invention, a noise reduction device is formed with the discharge muffler 200, the gasket 210 and the discharge valve piece 220. That is, a shape of a side branch resonator, especially, a Helmholtz resonator in this embodiment, is formed using those three components.

For this, the gasket 210 has a Helmholtz cutout 213 formed therethrough, which includes a throat section 216 and a resonant section 212. As shown in FIG. 4, when the gasket 210 is sandwiched between the discharge muffler 200 and the discharge valve piece 220, a lower surface of the muffler plate 201 and an upper surface of the discharge valve piece 220 block the Helmholtz cutout 213 vertically. As a result, a certain volume of a space for the Helmholtz resonator is formed with the gasket 210 and the surrounding components 200 and 220 thereof.

A detailed specification of the space, i.e., its length l, width a, depth h, is determined to attenuate a noise of particular frequencies, e.g., 2.5 kHz or 3.15 kHz.

A second embodiment of the present invention is now described with reference to FIGS. 5 through 6C.

Figure 5:
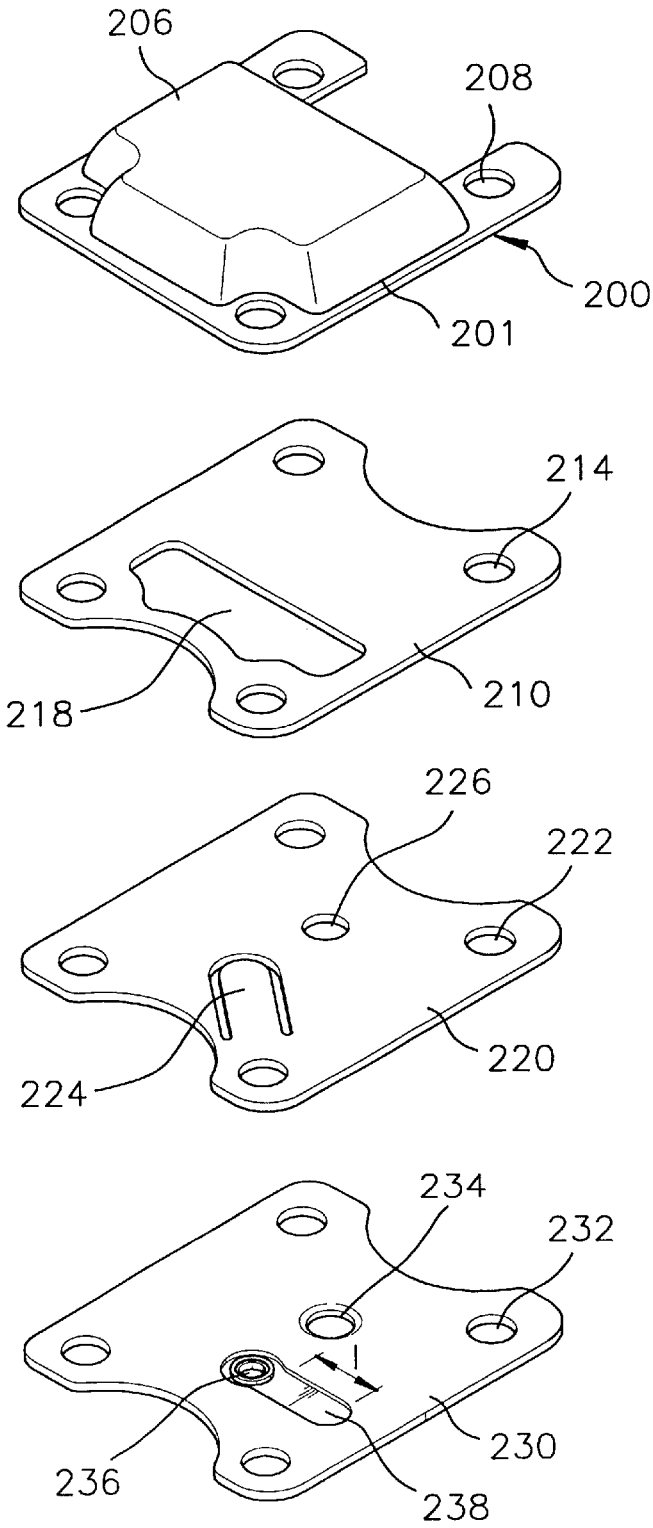
FIG. 5 shows an exploded perspective view of a second embodiment of the present invention.

As shown in FIG. 5, a noise reduction device in accordance with the second embodiment is formed with the valve plate 230 and the discharge valve piece 220. That is, in order to make a certain volume of a space for the side branch resonator, a resonant groove 238 is formed on the valve plate 230 at a predetermined depth around the discharge plate hole 236; and the resonant groove 238 is covered with a lower surface of the discharge valve piece 220.

Figure 6A:
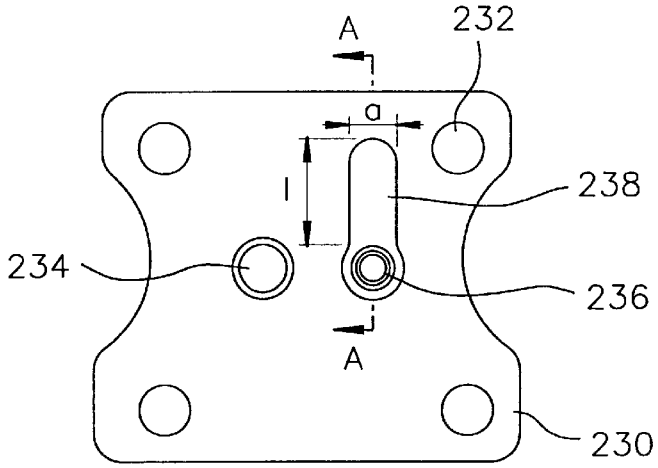
FIGS. 6A and 6B present a top planar view and a bottom view of a valve plate shown in FIG. 5, respectively.
Figure 6B:
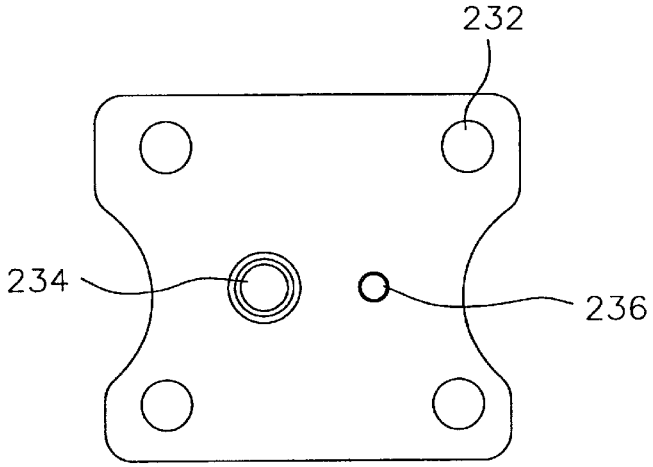
Figure 6C:
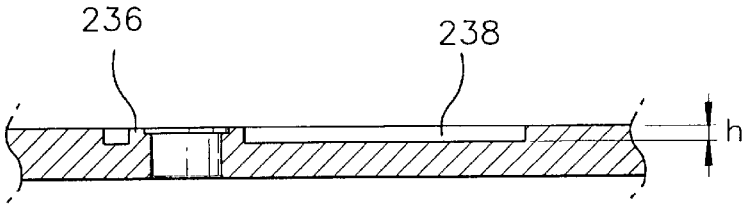
FIG. 6C represents a sectional view of the valve plate shown in FIG. 5, when taken along the line A—A.

As shown in FIGS. 6A and 6C, the volume of the space defined by the resonant groove 238 and the discharge valve piece 220 may be calculated by using the following formula:

$$f = \frac{C}{2\Pi}\sqrt{\frac{AH}{Vc(L+1.7R)}}$$

wherein f is a frequency to be attenuated, C is a speed of the sound generated by the refrigerant gases, A is the width of the space, H is the depth of the space, Vc is the volume of the space, L is the length of the space, and R is an equivalent radius defined with an equation as follows:

$$\sqrt{\frac{AH}{\Pi}}$$

The noise reduction device in accordance with the second embodiment can be concurrently formed on the valve plate by pressing or forging used in manufacturing the valve plate 230.

A third embodiment of the present invention is now described with reference to FIGS. 7A and 7B.

Figure 7A:
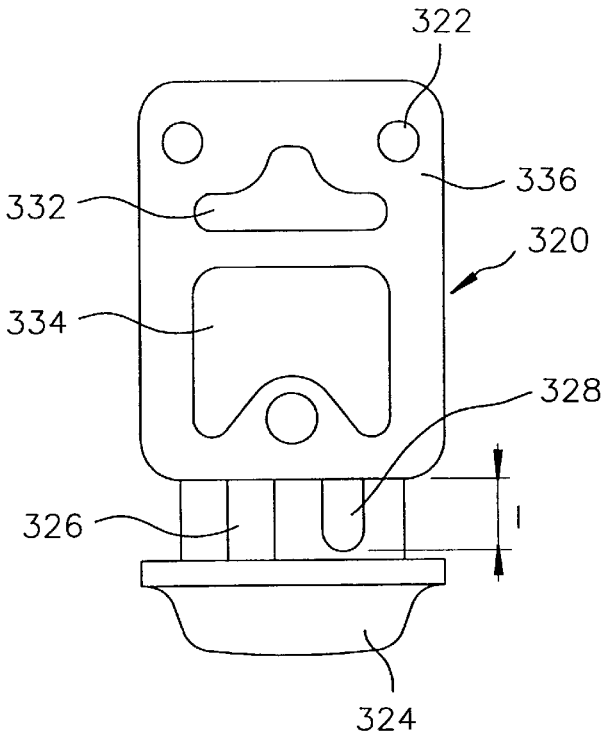
FIGS. 7A and 7B give a front elevational view and a side elevational view of a discharge muffler of a third embodiment of the present invention, respectively.
Figure 7B:
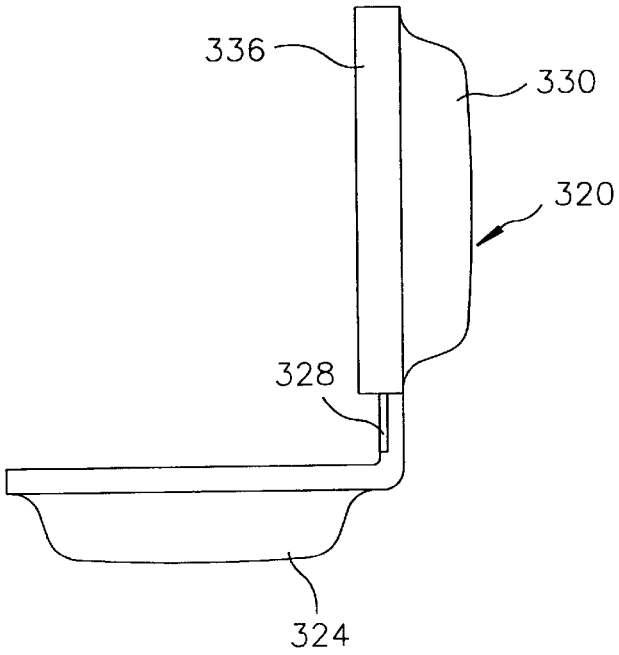

As shown in FIGS. 7A and 7B, a noise reduction device in accordance with the third embodiment is formed on a discharge muffler 320. The discharge muffler 320 in this embodiment has a first room defined by a discharge valve cover 330, and a second room defined by a muffler cup 324.

The discharge muffler 320 also has a muffler plate 336. The muffler plate 336 has an intake muffler hole 332 through which the refrigerant gases are introduced into the cylinder, a discharge muffler hole 334 through which the refrigerant gases are emitted from the cylinder into the discharge valve cover 330, and a delivery hole (not shown) through which the refrigerant gases are discharged from the discharge valve cover 330. A plurality of bolt holes 322 are formed throughout the muffler plate 336, through which bolts are engaged to fix the discharge muffler 320 on the cylinder block. A passage way connection 326 is formed with the discharge muffler 320 to connect the delivery hole with the muffler cup 324, allowing them to communicate with each other.

In this embodiment, a resonant groove 328 is made on the muffler plate 336 at a predetermined depth to form the noise reduction device which is parallel to the passage way connection 326. The resonant groove 328 is covered with the cylinder block, when the discharge muffler 320 is assembled thereon top. Accordingly, the noise reduction device defined by the resonant groove 328 and the cylinder block will have a space of a certain volume.

A length of the resonant groove 328 to attenuate the noise of a particular frequency is determined by a following equation:

$$fn = \frac{nc}{2l}$$

wherein f is a frequency to be attenuated, n is an integer (=1, 2, 3, . . . ), c is a speed of the sound generated by the refrigerant gases, and l is a length of the resonant groove. As a preferred example, the volume of the resonant groove 328 ranges from 0.04 to 0.1 cc.

A fourth embodiment of the present invention is now described with reference to FIG. 8.

Figure 8:
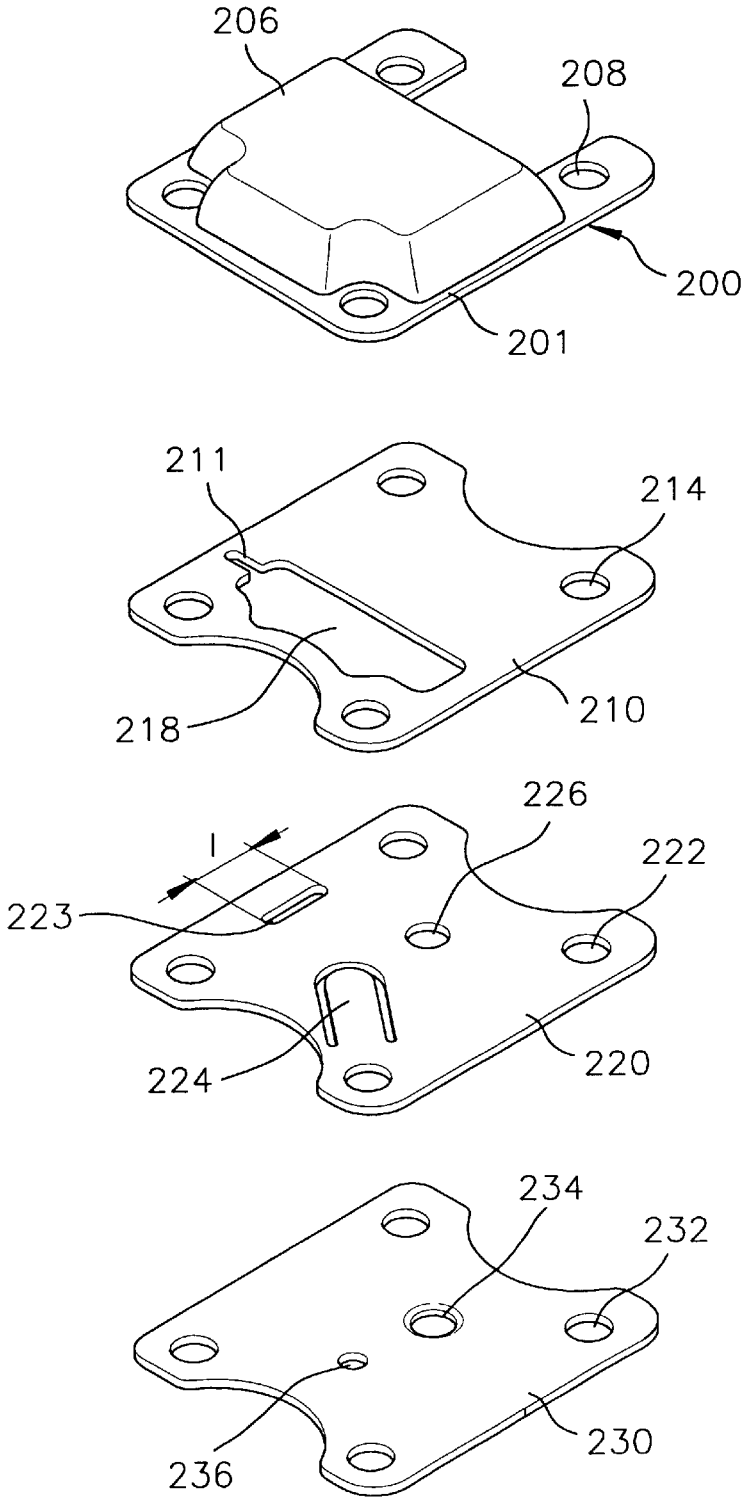
FIG. 8 shows an exploded perspective view of a fourth embodiment of the present invention.

As shown in FIG. 8, a noise reduction device in accordance with the fourth embodiment is formed by using the gasket 210, the discharge valve piece 220 and the valve plate 230. That is, an intermediate passage 211 is formed through the gasket 210 to communicate with the discharge passage 218; and the discharge valve piece 220 has a resonant hole 223 formed therethrough. The intermediate passage 211 and the resonant hole 223 communicate with each other, when they are assembled on the cylinder block. At this time, the resonant hole 223 is blocked by an upper surface of the valve plate 230. As a result, a certain volume of a space is defined about the resonant hole 223.

A length of the resonant hole 223 to attenuate the noise of a particular frequency is given as follows:

$$fn = \frac{nc}{2l}$$

wherein f is a frequency to be attenuated, n is an integer (=1, 2, 3, . . . ), c is a speed of the sound generated by the refrigerant gases, and l is a length of the resonant groove. As a preferred example, the volume of the resonant groove 223 ranges from 0.04 to 0.1 cc.

Figure 9:
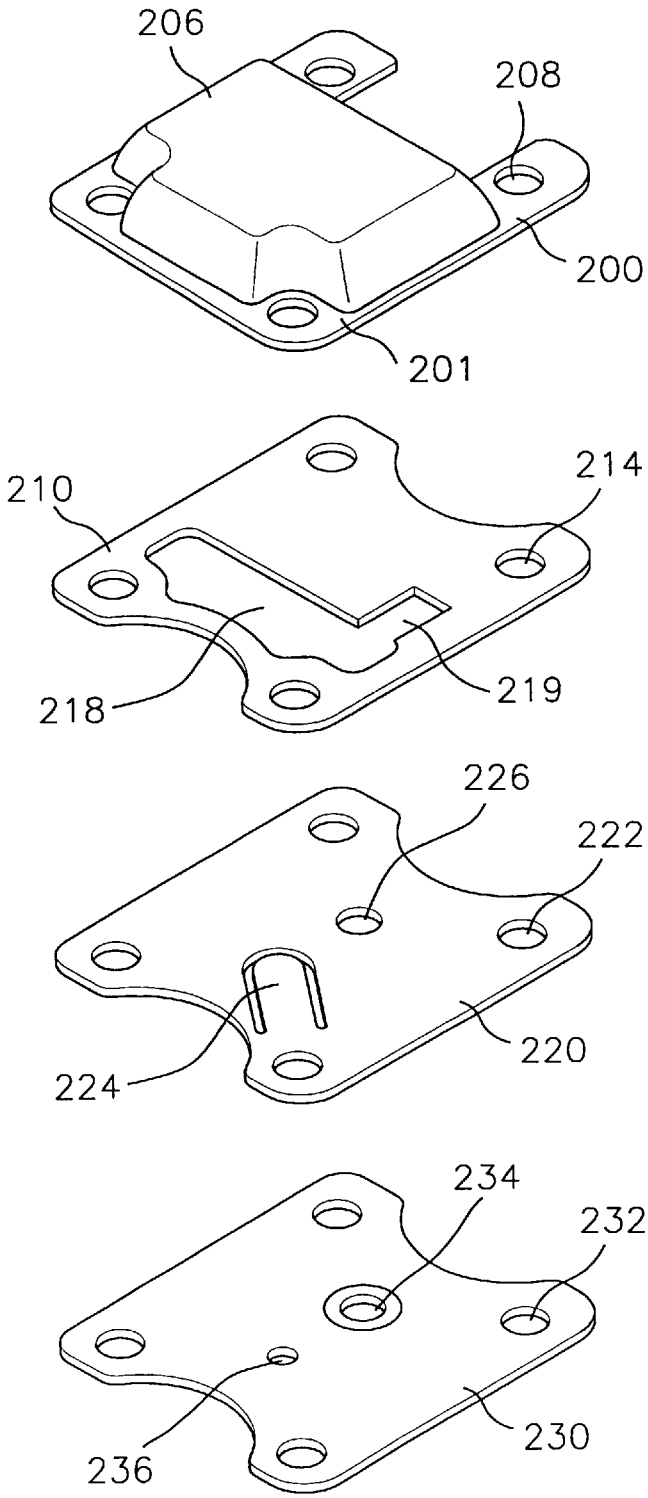
FIG. 9 shows an exploded perspective view of a modification of the first embodiment of the present invention.
Figure 10:
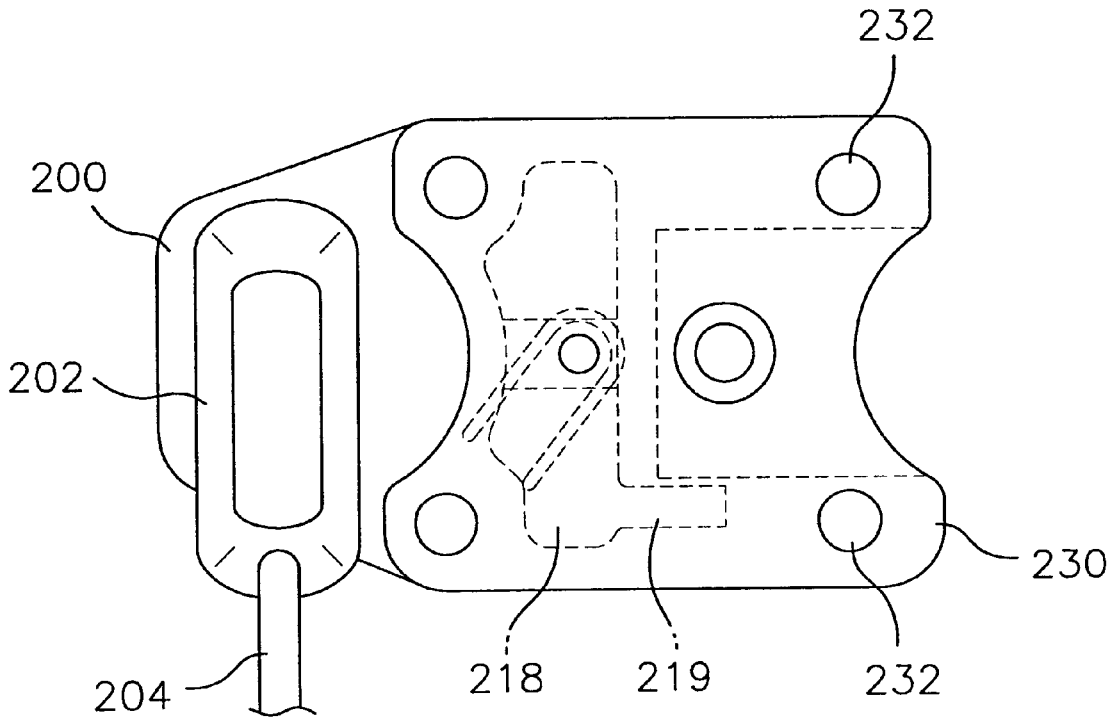
FIG. 10 presents a bottom view of the components shown in FIG. 9, when they are assembled together.

In FIGS. 9 and 10, there is shown a modification of the first embodiment. Unlike the first embodiment, its modification has a closed tube type side branch as a noise reduction device. The noise reduction device is formed by a cut-out 219 formed through the gasket 210, which is blocked vertically by both the muffler plate 200 and the discharge valve piece 220. A specification of the cutout 219 may be properly determined to attenuate a noise of a particular frequency.

Although the invention has been shown and described with respect to the preferred embodiments, it will be understood by those skilled in the art that various changes and modifications may be made without departing from the spirit and scope of the invention as defined in the following claims.

What is claimed is:

1. A noise reduction assembly suitable for mounting on a cylinder block, the noise reduction assembly comprising:

a valve plate having a first plurality of bolt holes arranged in a predetermined pattern, the valve plate having a resonant groove formed on a first side thereof, the resonant groove having a predetermined depth and surrounding a discharge plate hole of the valve plate;

a discharge valve piece having a second plurality of bolt holes also arranged in said predetermined pattern, the discharge valve piece further having a reed valve integrally formed therewith;

a gasket having a third plurality of bolt holes also arranged in said predetermined pattern, the gasket further having a discharge passage provided therein; and a muffler plate having a fourth plurality of bolt holes also arranged in said predetermined pattern, wherein the noise reduction assembly is movable between a disassembled state in which the valve plate, discharge valve piece, gasket and muffler plate are separated from one another, and an assembled state in which:

the first side of the valve plate is juxtaposed against a first side of the discharge valve piece such that the reed valve is opposite the discharge plate hole;

a second side of the discharge valve plate is juxtaposed against a first side of the gasket such that the discharge passage is opposite the reed valve;

a second side of the gasket is juxtaposed against a first side of the muffler plate, and the first, second, third and fourth pluralities of bolt holes are aligned with one another.

2. The noise reduction assembly according to claim 1, wherein the discharge valve piece and the reed valve have unitary construction.

3. A noise reduction device for use in a discharge valve assembly mounted on a cylinder block of a reciprocating compressor, the noise reduction device comprising:

a discharge muffler for attenuating noise in a frequency range; and a side branch resonator for attenuating noise at one or more discrete frequencies located in the frequency range;

wherein the frequency of the noise which is attenuated by the side branch resonator is 3.15 kHz.

4. The noise reduction device of claim 3, wherein the side branch resonator is disposed inside the discharge valve assembly and includes a resonant chamber located besides a refrigerant gas passage of the reciprocating compressor through which a refrigerant gas flows and communicating means for acoustically connecting the resonant chamber with the refrigerant gas passage.

5. The noise reduction device of claim 3, wherein the discharge valve assembly includes an inlet through which a refrigerant gas discharged from the cylinder block flows into the discharge valve assembly and an outlet through which the refrigerant gas is discharged from the discharge valve assembly, the discharge muffler being disposed between the input and the output and the side branch resonator being located between the input and the discharge muffler.

6. The noise reduction device of claim 5, wherein the discharge valve assembly includes a gasket located between the inlet and the discharge muffler, the gasket having a discharge passage through which the refrigerant gas flows, and the resonant chamber is formed on the gasket besides the discharge passage, the resonant chamber having a substantially rectangular shape, and the communicating means is a rectangular-shaped channel having a same width as the resonant chamber.

7. The noise reduction device of claim 5, wherein the discharge valve assembly includes a gasket located between the inlet and the discharge muffler, the gasket having a discharge passage through which the refrigerant gas flows, and the resonant chamber is formed on the gasket besides the discharge passage, the resonant chamber having a substantially circular shape, and the communicating means is a rectangular-shaped channel having a smaller width than a diameter of the resonant chamber.

8. The noise reduction device of claim 5, wherein the discharge valve assembly includes a valve plate located between the inlet and the discharge muffler, the valve plate having a discharge plate hole through which the refrigerant gas flows, and the resonant chamber is formed on the valve plate, the resonant chamber having a substantially rectangular shape, and the communicating means is a channel surrounding the discharge plate hole and communicating with the resonant chamber.

9. The noise reduction device of claim 5, wherein the discharge valve assembly includes a gasket having a discharge passage and a discharge valve piece having a reed valve, the refrigerant gas flowing from the reed valve to the discharge passage, and the resonant chamber is formed on the discharge valve piece and the communicating means is formed on the gasket for connecting the discharge passage with the resonant chamber.

10. A noise reduction device of claim 5, wherein the discharge muffler includes a first room, a second room, a connecting member for connecting the first room and the second room and a passageway formed on the connecting member for allowing a refrigerant gas to flow from the first room to the second room, and the resonant chamber has a substantially rectangular shape and formed on the connecting member, and the communicating means is a rectangular-shaped channel having a same width as the resonant chamber.

11. A noise reduction device for use in a discharge valve assembly mounted on a cylinder block of a reciprocating compressor, the noise reduction device comprising:

a discharge muffler for attenuating noise in a frequency range; and a side branch resonator for attenuating noise at one or more discrete frequencies located in the frequency range;

wherein the frequency of the noise which is attenuated by the side branch resonator is 2.5 kHz.

12. The noise reduction device of claim 11, wherein the side branch resonator is disposed inside the discharge valve assembly and includes a resonant chamber located besides a refrigerant gas passage of the reciprocating compressor through which a refrigerant gas flows and communicating means for acoustically connecting the resonant chamber with the refrigerant gas passage.

13. The noise reduction device of claim 11, wherein the discharge valve assembly includes an inlet through which a refrigerant gas discharged from the cylinder block flows into the discharge valve assembly and an outlet through which the refrigerant gas is discharged from the discharge valve assembly, the discharge muffler being disposed between the input and the output and the side branch resonator being located between the input and the discharge muffler.

14. The noise reduction device of claim 13, wherein the discharge valve assembly includes a gasket located between the inlet and the discharge muffler, the gasket having a discharge passage through which the refrigerant gas flows, and the resonant chamber is formed on the gasket besides the discharge passage, the resonant chamber having a substantially rectangular shape, and the communicating means is a rectangular-shaped channel having a same width as the resonant chamber.

15. The noise reduction device of claim 13, wherein the discharge valve assembly includes a gasket located between the inlet and the discharge muffler, the gasket having a discharge passage through which the refrigerant gas flows, and the resonant chamber is formed on the gasket besides the discharge passage, the resonant chamber having a substantially circular shape, and the communicating means is a rectangular-shaped channel having a smaller width than a diameter of the resonant chamber.

16. The noise reduction device of claim 13, wherein the discharge valve assembly includes a valve plate located between the inlet and the discharge muffler, the valve plate having a discharge plate hole through which the refrigerant gas flows, and the resonant chamber is formed on the valve plate, the resonant chamber having a substantially rectangular shape, and the communicating means is a channel surrounding the discharge plate hole and communicating with the resonant chamber.

17. The noise reduction device of claim 13, wherein the discharge valve assembly includes a gasket having a discharge passage and a discharge valve piece having a reed valve, the refrigerant gas flowing from the reed valve to the discharge passage, and the resonant chamber is formed on the discharge valve piece and the communicating means is formed on the gasket for connecting the discharge passage with the resonant chamber.

18. A noise reduction device of claim 11, wherein the discharge muffler includes a first room, a second room, a connecting member for connecting the first room and the second room and a passageway formed on the connecting member for allowing a refrigerant gas to flow from the first room to the second room, and the resonant chamber has a substantially rectangular shape and formed on the connecting member, and the communicating means is a rectangular-shaped channel having a same width as the resonant chamber.

* * * * *